US010837275B2

(12) United States Patent
Noske

(10) Patent No.: US 10,837,275 B2
(45) Date of Patent: Nov. 17, 2020

(54) LEAK DETECTION FOR DOWNHOLE ISOLATION VALVE

(71) Applicant: Weatherford Technology Holdings, LLC, Houston, TX (US)

(72) Inventor: Joe Noske, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 363 days.

(21) Appl. No.: 15/425,868

(22) Filed: Feb. 6, 2017

(65) Prior Publication Data

US 2018/0223651 A1 Aug. 9, 2018

(51) Int. Cl.

| | |
|---|---|
| ***E21B 47/117*** | (2012.01) |
| ***E21B 34/14*** | (2006.01) |
| ***E21B 47/06*** | (2012.01) |
| ***E21B 47/12*** | (2012.01) |
| ***E21B 34/10*** | (2006.01) |
| ***E21B 47/10*** | (2012.01) |

(52) U.S. Cl.

CPC ..... *E21B 47/117* (2020.05); *E21B 34/10* (2013.01); *E21B 34/14* (2013.01); *E21B 47/06* (2013.01); *E21B 47/10* (2013.01); *E21B 47/12* (2013.01); *E21B 2200/05* (2020.05)

(58) Field of Classification Search

CPC ..... E21B 47/1025; E21B 2034/005; E21B 3/2876

See application file for complete search history.

(56) References Cited

U.S. PATENT DOCUMENTS 3,052,126 A * 9/1962 Laas ..... G01L 11/006 73/716
3,521,659 A * 7/1970 Seger ..... F16K 15/033 137/112
3,860,033 A * 1/1975 Grove ..... F16K 11/065 137/557
4,043,355 A 8/1977 Cerruti et al.
4,100,969 A * 7/1978 Randermann, Jr. ..... E21B 34/12 137/629
4,771,633 A * 9/1988 Jacob ..... E21B 34/10 73/46
4,901,798 A * 2/1990 Amani ..... E21B 34/10 166/311
5,269,171 A * 12/1993 Boyer ..... G01M 3/2807 73/40.5 R
5,404,905 A * 4/1995 Lauria ..... E03B 7/077 137/312

(Continued)

OTHER PUBLICATIONS

PCT International Search Report and Written Opinion in related application PCT/US2018/016067 dated Jun. 19, 2018.

*Primary Examiner* — Shane Bomar
(74) *Attorney, Agent, or Firm* — Patterson + Sheridan, LLP

(57) ABSTRACT

An isolation valve for use with a tubular string includes a tubular housing for connection with the tubular string; a first closure member disposed in the housing and movable between an open position and a closed position; a second closure member disposed in the housing and movable between an open position and a closed position; a chamber formed between the first closure member and the second closure member when the first and second closure members are in the closed position; and a leak detection device configured to measure a fluid flow into the chamber.

23 Claims, 9 Drawing Sheets

(56) References Cited

U.S. PATENT DOCUMENTS

| | | | | |
|---|---|---|---|---|
| 5,713,240 | A * | 2/1998 | Engelmann | F16K 15/035 73/168 |
| 7,086,481 | B2 | 8/2006 | Hosie et al. | |
| 7,178,600 | B2 | 2/2007 | Luke et al. | |
| 7,219,729 | B2 | 5/2007 | Bostick, III et al. | |
| 7,255,173 | B2 | 8/2007 | Hosie et al. | |
| 7,350,590 | B2 | 4/2008 | Hosie et al. | |
| 7,413,018 | B2 | 8/2008 | Hosie et al. | |
| 7,451,809 | B2 | 11/2008 | Noske et al. | |
| 7,451,828 | B2 | 11/2008 | Marsh | |
| 7,730,968 | B2 | 6/2010 | Hosie et al. | |
| 2004/0251032 | A1 | 12/2004 | Luke et al. | |
| 2013/0180317 | A1 | 7/2013 | Welker et al. | |
| 2014/0041863 | A1 | 2/2014 | Dowling et al. | |

* cited by examiner

LEAK DETECTION FOR DOWNHOLE ISOLATION VALVE

BACKGROUND OF THE DISCLOSURE

Field of the Disclosure

The present disclosure generally relates to a downhole isolation valve and use thereof. In particular, embodiments of the present disclosure relate apparatus and methods of detecting a leak across an isolation element.

Description of the Related Art

A wellbore is formed to access hydrocarbon bearing formations, e.g. crude oil and/or natural gas, by the use of drilling. Drilling is accomplished by utilizing a drill bit that is mounted on the end of a drill string. To drill the wellbore, the drill string is rotated by a top drive or rotary table on a surface platform or rig, and/or by a downhole motor mounted towards the lower end of the drill string. After drilling a first segment of the wellbore, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. In some instances, the casing string is not cemented and is retrievable. The combination of cement and casing strengthens the wellbore and facilitates the isolation of certain areas of the formation behind the casing.

An isolation valve assembled as part of the casing string may be used to temporarily isolate a formation pressure across the isolation valve such that a portion of the wellbore above the isolation valve may be temporarily relieved to atmospheric pressure. Since the pressure above the isolation valve is relieved, the drill/work string can be tripped into the wellbore without wellbore pressure acting to push the string out and tripped out of the wellbore without concern for swabbing the exposed formation.

Currently, a leak from a downhole isolation valve is generally detected at surface by detecting an increase in flow. However, the amount of time for a leak to be detected at surface may prevent some contingency actions. Also, the perceived flow increase might not be caused by a leak. For example, gas generally expands as it travels uphole, which may result in a perceived flow increase. There is a need, therefore, for apparatus and methods for detecting leakage downhole.

SUMMARY OF THE DISCLOSURE

In one embodiment, an isolation valve for use with a tubular string includes a tubular housing for connection with the tubular string; a first closure member disposed in the housing and movable between an open position and a closed position; a second closure member disposed in the housing and movable between an open position and a closed position; a chamber formed between the first closure member and the second closure member when the first and second closure members are in the closed position; and a leak detection device configured to measure a fluid flow into the chamber.

In another embodiment, a method of detecting a leak across an isolation valve includes closing a first isolation member to block fluid communication through a bore; closing a second isolation member located upstream from the first isolation chamber, thereby defining a chamber between the first and second isolation chambers; and measuring fluid flow into the chamber.

In another embodiment, a method of detecting a fluid leak across an isolation valve in a bore of a tubular includes closing the isolation valve to block fluid communication through the bore; measuring a downhole pressure of the bore above the isolation valve; and determining the fluid leak in response to the measured downhole pressure.

In another embodiment, an isolation valve for use with a tubular string includes a tubular housing for connection with the tubular string and having a bore; a closure member disposed in the housing and movable between an open position and a closed position; and a pressure gauge for measuring a pressure in the bore above the closure member when the closure member is in the closed position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally relate to an isolation valve. The isolation valve may be a downhole deployment valve. In one or more of the embodiments described herein, the isolation valve may include one or more leak detection devices for detecting a leak across the isolation valve.

Figure 1A:
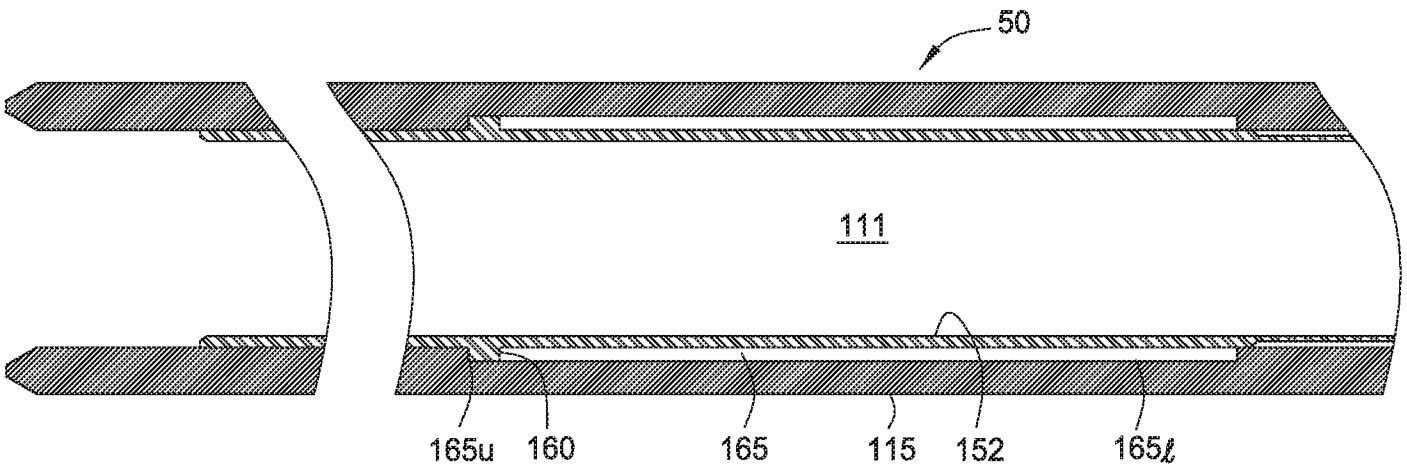
FIGS. 1A and 1B illustrate an exemplary isolation valve in the closed position.
Figure 1B:
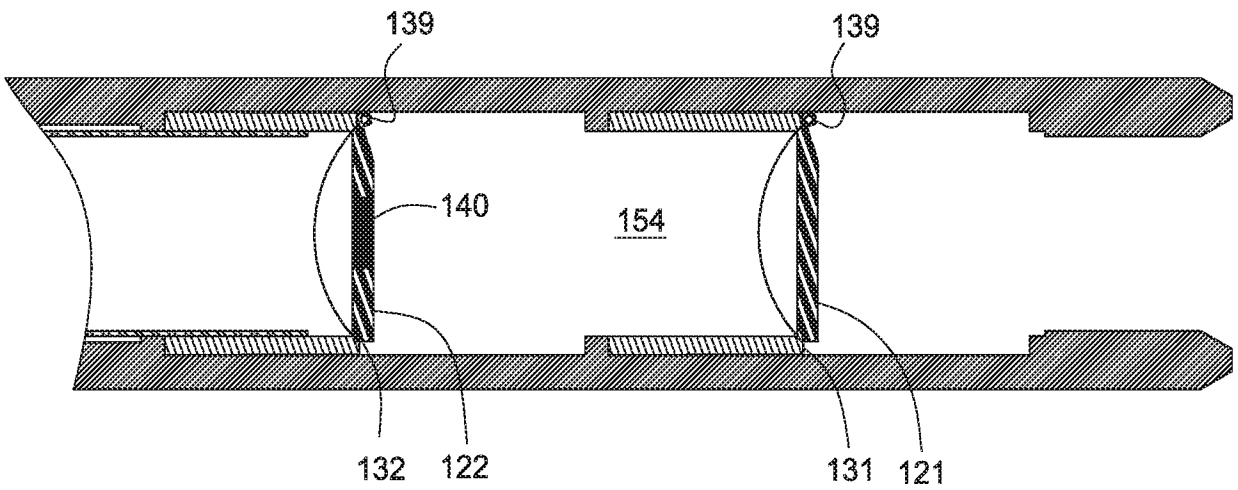

FIGS. 1A and 1B illustrate an exemplary embodiment of an isolation valve 50 in a closed position. The isolation valve 50 includes a tubular housing 115, an opener such as a flow tube 152, a first isolation member 121, and a second isolation member 122. The second isolation member 122 may include a flow measuring device 140. To facilitate manufacturing and assembly, the housing 115 may include one or more sections connected together, such by threaded couplings and/or fasteners. The upper and lower portions of the housing 115 may include threads, such as a pin or box, for connection to other casing sections of a casing string. Interfaces between the housing sections and the casing may be isolated, such as by using seals. The isolation valve 50 may have a longitudinal bore 111 extending therethrough for passage of fluid and the drill string.

In one embodiment, the first and second isolation members 121, 122 are flappers. The flappers 121, 122 engage a respective seat 131, 132 when the flappers are in the closed position. The flappers 121, 122 may be pivotally coupled to the seats 131, 132 using a hinge 139. The flappers 121, 122 pivot about the hinge 139 between an open position, as shown in FIG. 2B, and a closed position, as shown in FIG. 1B. The flappers 121, 122 may be positioned below the seats 131, 132 such that the flappers 121, 122 open downwardly. An inner periphery of the flappers 121, 122 engages the seats 131, 132 in the closed position, thereby closing fluid communication through the isolation valve 50. The interface between the flappers 121, 122 and the seats 131, 132 may be a metal to metal seal, or metal to elastomeric seal. The flappers 121, 122 may be biased toward the closed position such as by a spring.

Figure 2A:
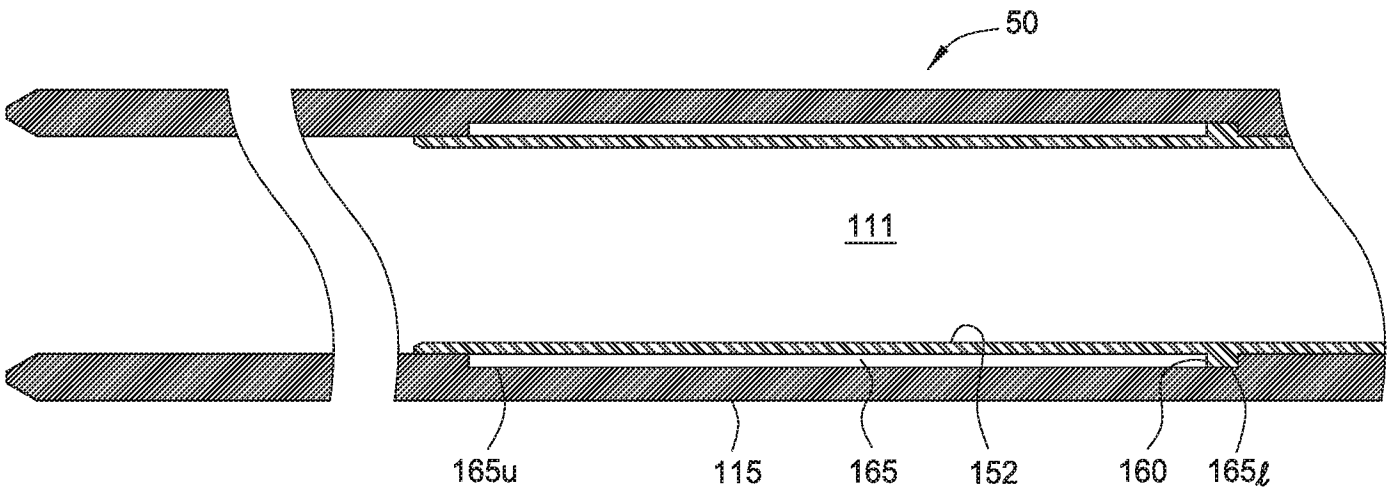
FIGS. 2A and 2B illustrate the isolation valve of FIGS. 1A-1B in the open position.
Figure 2B:
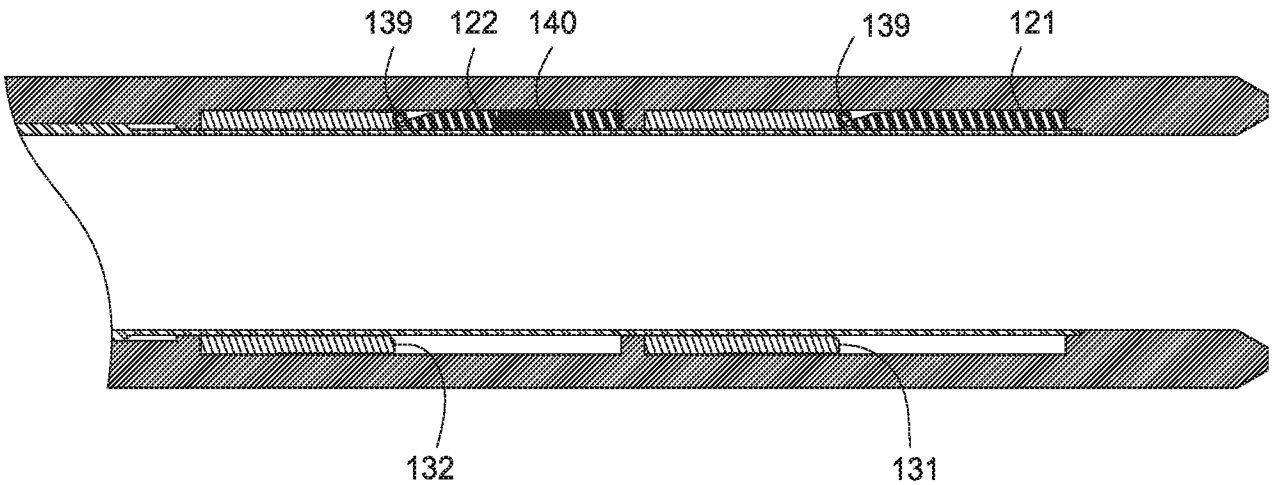

The flow tube 152 is disposed within the housing 115 and longitudinally movable relative thereto between an upper position, as shown in FIGS. 1A-1B, and a lower position, as shown in FIGS. 2A-2B. The flow tube 152 is configured to urge the flappers 121, 122 toward the open position when the flow tube 152 moves to the lower position. The flow tube 152 may have one or more portions connected together. A piston 160 is coupled to the flow tube 152 for moving the flow tube 152 between the lower position and the upper position. The piston 160 carries a seal for sealing an interface formed between an outer surface of the piston 160 and an inner surface of the housing 115. In another embodiment, each of the flappers 121, 122 is operated using separate flow tubes. In another embodiment, a plurality of flow tubes and a plurality of pistons may be used to open or close each flapper 121, 122.

A piston chamber 165 is disposed between an inner surface of the housing 115 and an outer surface of the flow tube 152. The piston chamber 165 may be defined radially between the flow tube 152 and a recess in the housing 115 and longitudinally between an upper shoulder and a lower shoulder in the recess. The piston 160 separates the chamber 165 into an upper chamber 165*u* and a lower chamber 165*l*. Each of the lower chamber 165*l* and the upper chamber 165*u* fluidly communicates with a respective control line that extends to the surface. Fluid is supplied to the upper chamber 165*u* to move the piston 160 and the flow tube 152 downward to the lower position. To return the flow tube 152 to the upper position, fluid is supplied to the lower chamber 165*l* to move the piston 160 and the flow tube 152 upward.

The flappers 121, 122 are opened and closed by interaction with the flow tube 152. FIGS. 1A-1B show the flappers 121, 122 in the closed position. Downward movement of the flow tube 152 causes the lower portion of the flow tube 152 to initially engage with the second flapper 122 and then the first flapper 121, thereby pushing and pivoting the flappers 121, 122 to the open position against the springs. The flow tube 152 is urged downward when the pressure in the upper chamber 165*u* is greater than the pressure in the lower chamber 165*l*. The pressure differential between the upper chamber 165*u* and the lower chamber 165*l* may be controlled by increasing the pressure in the upper chamber 165*u*, decreasing the pressure in the lower chamber 165*l*, or combinations thereof. Pressure in the upper chamber 165*u* and the lower chamber 165*l* may be controlled via their respective control lines. An optional biasing member such as a spring may be disposed in the lower chamber 165*l* to bias the flow tube 160 in the upper position, such that the flappers 121, 122 are allowed to close.

FIGS. 2A-2B show the flappers 121, 122 in the open position. As shown, the flow tube 152 has extended past and pivoted the flappers 121, 122 to the open position. The flow tube 152 may sealingly engage an inner surface of the housing 115 below the first flapper 121. Also, the piston 160 has moved downward relative to the housing 115, thereby decreasing the size of the lower chamber 165*l*.

To close the flappers 121, 122, the flow tube 152 is moved upward to disengage from the flappers 121, 122, thereby allowing the flappers 121, 122 to pivot to the closed position. In one embodiment, the flappers 121, 122 are pivoted to the closed position by their respective spring. The flow tube 152 is urged upward when the pressure in the lower chamber 165*l* is greater than the pressure in the upper chamber 165*u*. The pressure differential between the upper chamber 165*u* and the lower chamber 165*l* may be controlled by decreasing the pressure in the upper chamber 165*u*, increasing the pressure in the lower chamber 165*l*, or combinations thereof. Pressure in the upper chamber 165*u* and the lower chamber 165*l* may be controlled via their respective control lines. As shown in FIGS. 1A-1B, the flow tube 152 has retracted to a position above the second flapper 122. Also, the piston 160 has moved upward to reduce the size of the upper chamber 165*u*.

In one embodiment, a leak detection device is configured to detect fluid flow into an enclosed section 154 of the bore 111 between the two isolation members 121, 122. The enclosed section 154 is formed when the isolation members 121, 122 are closed. An exemplary leak detection device is a flow measuring device 140 attached to the second isolation member 122. The second isolation member 122 is positioned upstream from the first isolation member 121. Fluid migrating past the first isolation member 121 and into the enclosed section 154 will flow out of the enclosed section 154 through the flow measuring device 140. The rate of fluid flowing through the flow measuring device 140 will be proportional to the leakage occurring across the first isolation member 121. The flow measuring device 140 communicates the detected leak to surface via cable, a wireless communication system, or any suitable communication system. An exemplary flow measuring device is a flow meter. Suitable flow measuring devices include an optical multiphase flow meter or a venturi based flow meter.

In yet another embodiment, a gauge may be installed above the isolating member 121. The gauge is configured to determine a difference between the surface pressure and the pressure just above the flapper. In another embodiment, the pressure difference may be calculated between the gauge and another gauge located uphole. A change in the pressure differential would indicate a leak across the isolating member 121.

Figure 3A:
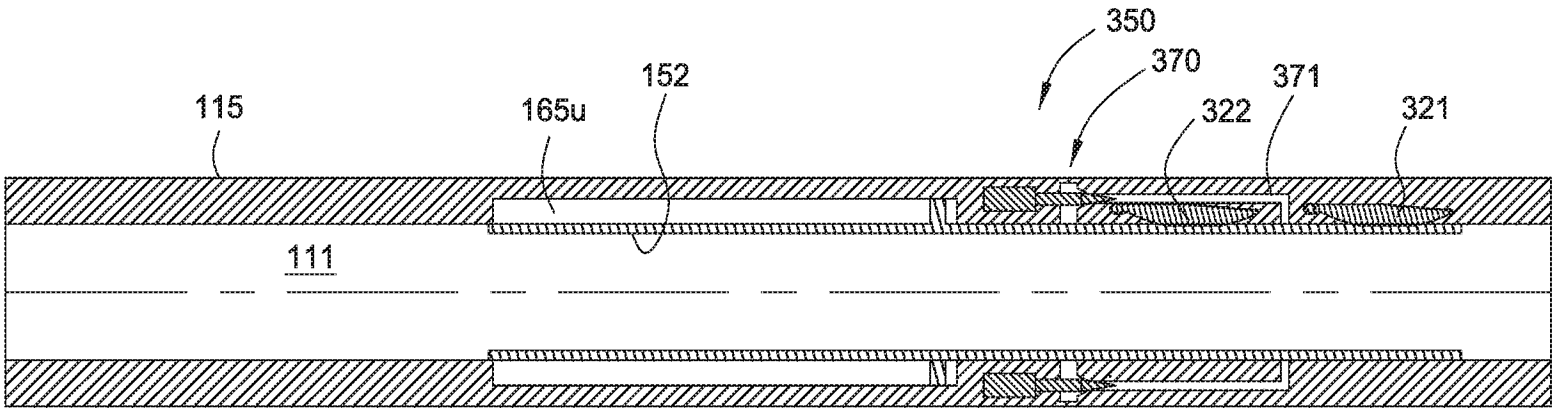
FIG. 3A illustrates another embodiment of an isolation valve in the open position.
Figure 3B:
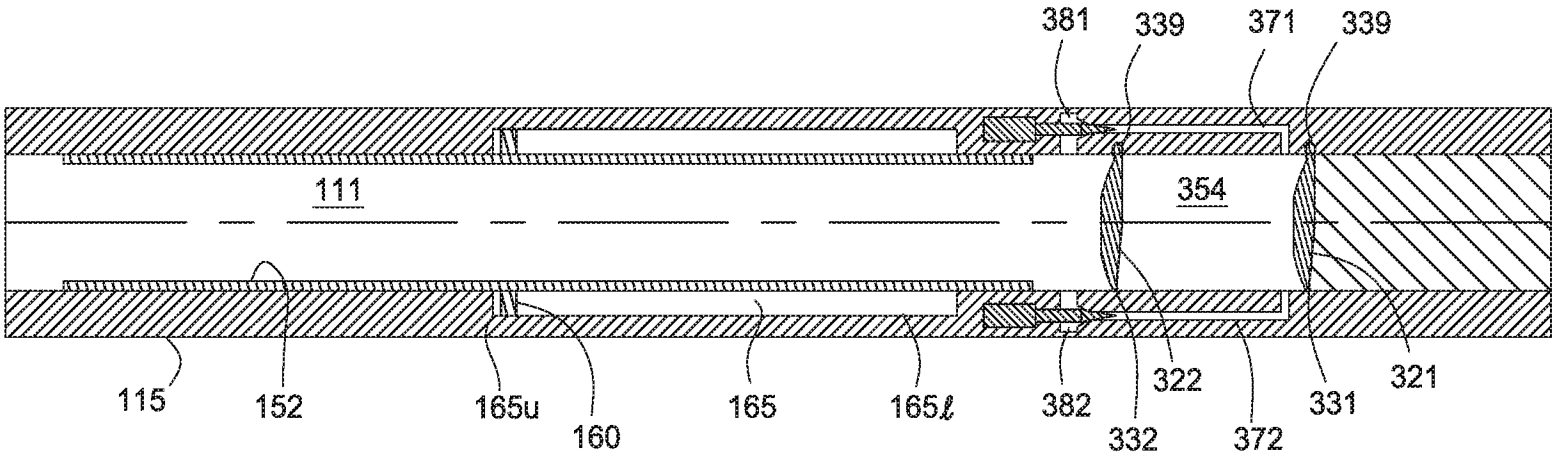
FIG. 3B illustrates the isolation valve of FIG. 3A in the closed position.

FIGS. 3A-3D illustrate another exemplary embodiment of an isolation valve 350. FIG. 3A shows the isolation valve 350 in an open position, and FIG. 3B shows the isolation valve 350 in the closed position. The isolation valve 350 includes a tubular housing 115, an opener such as a flow tube 152, a first isolation member 321, and a second isolation member 322. The isolation valve 350 may have a longitudinal bore 111 extending therethrough for passage of fluid and the drill string.

In one embodiment, the first and second isolation members 321, 322 are flappers. The flappers 321, 322 engage a respective seat 331, 332 when the flappers are in the closed position. The flappers 321, 322 may be pivotally coupled to the seats 331, 332 using a hinge 339. The flappers 321, 322 pivot about the hinge 339 between an open position, as shown in FIG. 3A, and a closed position, as shown in FIG. 3B. The flappers 321, 322 may be positioned below the seats 331, 332 such that the flappers 321, 322 open downwardly. An inner periphery of the flappers 321, 322 engages the seats 331, 332 in the closed position, thereby closing fluid communication through the isolation valve 350. The interface between the first flapper 321 and the seats 331 may be a metal to metal seal. In one embodiment, the second flapper 322 is made of an elastomeric material and forms an elastomeric seal with the seat 332. The flappers 321, 322 may be biased toward the closed position such as by a spring.

The flow tube 152 is disposed within the housing 115 and longitudinally movable relative thereto between an upper position (shown in FIG. 3B) and a lower position (shown in FIG. 3A). The flow tube 152 is configured to urge the flappers 321, 322 toward the open position when the flow tube 152 moves to the lower position. The flow tube 152 may have one or more portions connected together. A piston 160 is coupled to the flow tube 152 for moving the flow tube 152 between the lower position and the upper position. The piston 160 carries a seal for sealing an interface formed between an outer surface of the piston 160 and an inner surface of the housing 115.

A piston chamber 165 is disposed between an inner surface of the housing 115 and an outer surface of the flow tube 152. The piston chamber 165 may be defined radially between the flow tube 152 and a recess in the housing 115 and longitudinally between an upper shoulder and a lower shoulder in the recess. The piston 160 separates the chamber 165 into an upper chamber 165*u* and a lower chamber 165*l*. Each of the lower chamber 165*l* and the upper chamber 165*u* fluidly communicates with a respective control line. Fluid is supplied to the upper chamber 165*u* to move the piston 160 and the flow tube 152 downward to the lower position. To return the flow tube 152 to the upper position, fluid is supplied to the lower chamber 165*l* to move the piston 160 and the flow tube 152 upward.

The flappers 321, 322 are opened and closed by interaction with the flow tube 152. FIG. 3A shows the flappers 321, 322 in the open position. Downward movement of the flow tube 152 causes the lower portion of the flow tube 152 to initially engage with the second flapper 322 and then the first flapper 321, thereby pushing and pivoting the flappers 321, 322 to the open position against the springs. The flow tube 152 is urged downward when the pressure in the upper chamber 165*u* is greater than the pressure in the lower chamber 165*l*. The pressure differential between the upper chamber 165*u* and the lower chamber 165*l* may be controlled by increasing the pressure in the upper chamber 165*u*, decreasing the pressure in the lower chamber 165*l*, or combinations thereof. Pressure in the upper chamber 165*u* and the lower chamber 165*l* may be controlled via their respective control lines.

FIG. 3A shows the flappers 321, 322 in the open position. As shown, the flow tube 152 has extended past and pivoted the flappers 321, 322 to the open position. The flow tube 152 may sealingly engage an inner surface of the housing 115 below the first flapper 321. Also, the piston 160 has moved downward relative to the housing 115, thereby decreasing the size of the lower chamber 165*l*.

To close the flappers 321, 322, the flow tube 152 is moved upward to disengage from the flappers 321, 322, thereby allowing the flappers 321, 322 to pivot to the closed position. In one embodiment, the flappers 321, 322 are pivoted to the closed position by their respective spring. The flow tube 152 is urged upward when the pressure in the lower chamber 165*l* is greater than the pressure in the upper chamber 165*u*. The pressure differential between the upper chamber 165*u* and the lower chamber 165*l* may be controlled by decreasing the pressure in the upper chamber 165*u*, increasing the pressure in the lower chamber 165*l*, or combinations thereof. Pressure in the upper chamber 165*u* and the lower chamber 165*l* may be controlled via their respective control lines. As shown in FIG. 3B, the flow tube 152 has retracted to a position above the second flapper 322. Also, the piston 160 has moved upward to reduce the size of the upper chamber 165*u*.

In one embodiment, the isolation valve 350 includes a leak detection device. In one example, the leak detection device 370 includes one or more channels 371, 372 configured to fluidly communicate an enclosed section 354 of the bore 111 between the two isolation members 321, 322 with a section of the bore 111 above the second isolation member 322. In one embodiment, the fluid in the enclosed section 354 flows into an inlet of the channel 371 and flows out of an outlet of the channel 371 to the bore section above the second isolation flapper 322. While only two channels 371, 372 are shown, it is contemplated the isolation valve 350 may have one or more channels such as one channel, three channels, four channels, five channels, six channels, two to eight channels, and four to ten channels.

Figure 3C:
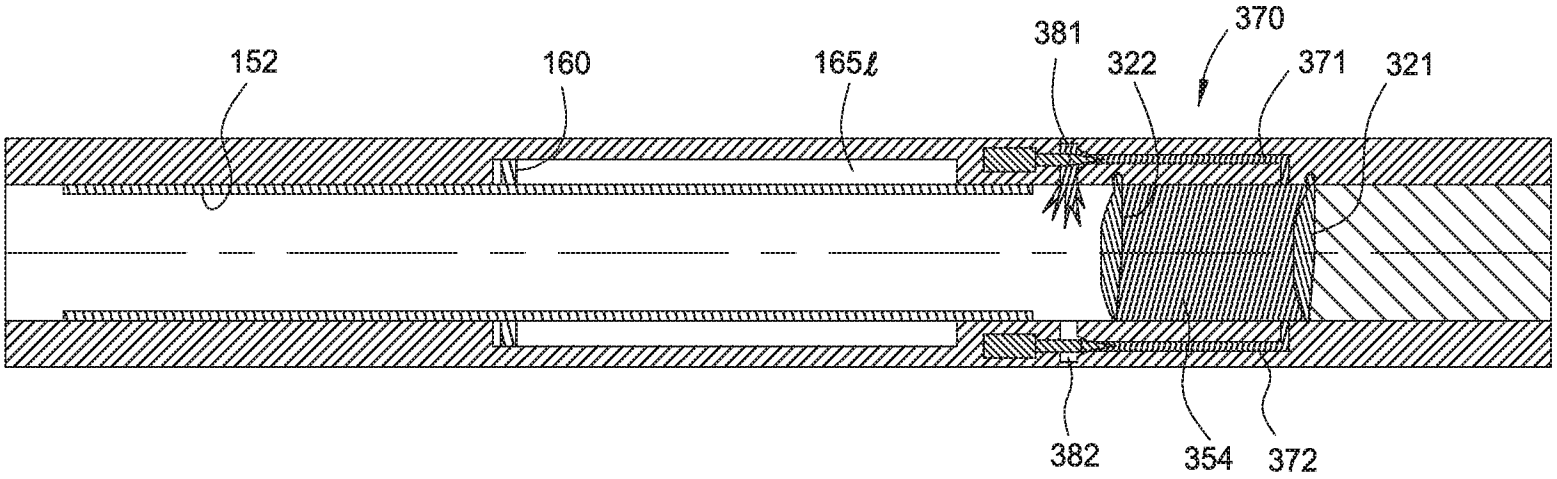
FIG. 3C illustrates the isolation valve of FIG. 3A having one measurement device in the open position.
Figure 3D:
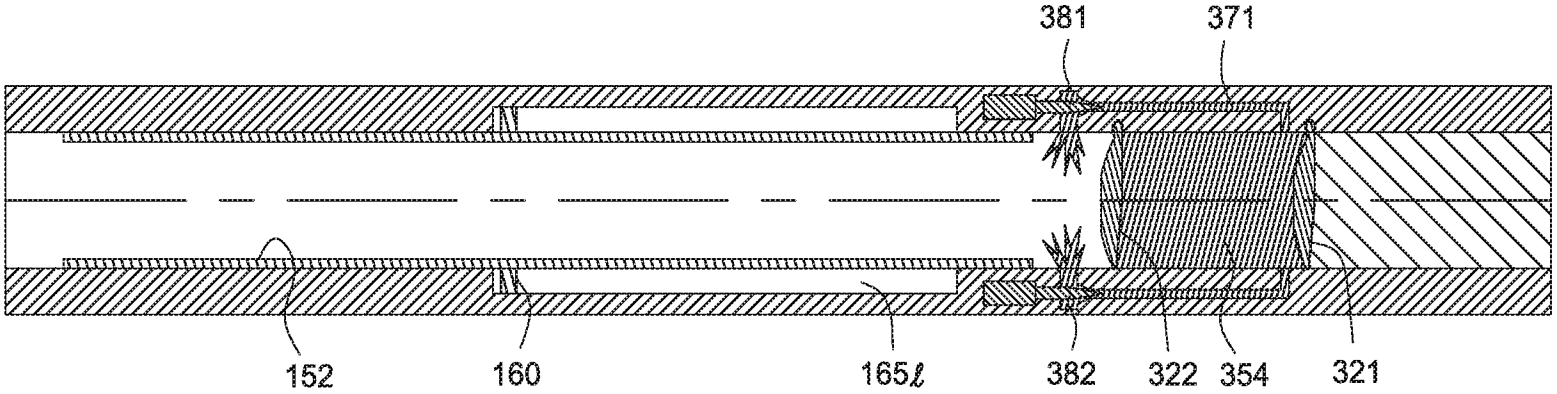
FIG. 3D illustrates the isolation valve of FIG. 3A having multiple measurement devices in the open position.

Each channel 371, 372 includes a measurement device, 382 to observe fluid communication through the respective outlet. In one embodiment, the measurement device opens when a predetermined pressure differential is reached to allow fluid communication through the outlet. Exemplary measurement devices include a pressure relief valve, a pop-off valve, and any suitable device configured to open at a predetermine pressure differential. In another embodiment, the measurement device may be a valve controlled by a potentiometer or a microelectromechanical flow meter configured to measure the flow rate. In one embodiment, a proportionate number of measurement devices 381, 382 will open in response to the flow rate. In another embodiment, the measurement devices 381, 382 are configured to activate at same or different pressure differentials. For example, a leak through the first flapper 321 will increase the pressure in the enclosed section 354, i.e., between the first flapper 321 and the second flapper 322. The pressure increase is communicated to the devices 381, 382 via the respective channels 371, 372. A pressure increase in the enclosed section 354 will increase the pressure differential between the enclosed section 354 and the bore section above the second flapper 322. When the pressure differential increases above the predetermined pressure differential of the measurement valve 381, one measurement valve 381 will open, as shown in FIG. 3C. However, the pressure differential may be insufficient to open the second measurement valve 382. As the leak increases thereby increasing the pressure in the enclosed section 354, more valves 382 will open, as shown in FIG. 3D. In one example, the isolation valve 350 may include four measurement valves each of which will open at the same predetermined pressure differential. For example, the measurement valves may open at a pressure differential between 0.5 psi and 50 psi, such as between 1 psi and 20 psi pressure differential. In operation, when the pressure differential between the enclosed section 354 and the bore section above the second flapper 322 is above 3 psi, the first measurement valve will open, while the other three measurement valves will remain closed. As the pressure differential increases to above 6 psi, the second measurement valve will open and two measurement valves will remain closed. When pressure differential increases to above 12 psi, all four measurement valves will open. In another example, at least two of the measurement valves may open at same or differential pressure differentials, such as 3 psi, 3 psi, 4 psi, and 4 psi opening pressure differentials. In this example, all four measurement valves will open when the pressure differential increases to above 14 psi. In yet another example, each of the four measurement valves may open at 1 psi, 2 psi, 3, psi, and 4 psi opening pressure differentials, in which case, all four measurement valves will open at a pressure differential above 10 psi. In another embodiment, the measurement valves may be configured to detect a change in the pressure differential. For example, the measurement valves may detect a change in the pressure differential between 0.5% and 25%, such as between 0.5% and 12% change in the pressure differential. In one example, a potentiometer, a micro-flow meter such as a MEMS flow meter, or an open/close valve with a position sensor may open the channel proportionately relative to the change in pressure differential. For example, the measurement valve can open 5% of the channel for fluid flow in response to a 5% change in the pressure differential.

The number of devices 381, 382 activated to the open position is communicated to the surface where the flow rate of the leak is determined and/or displayed. In another embodiment, the position of the activated valve 381, 382 is also communicated to the surface.

Figure 4A:
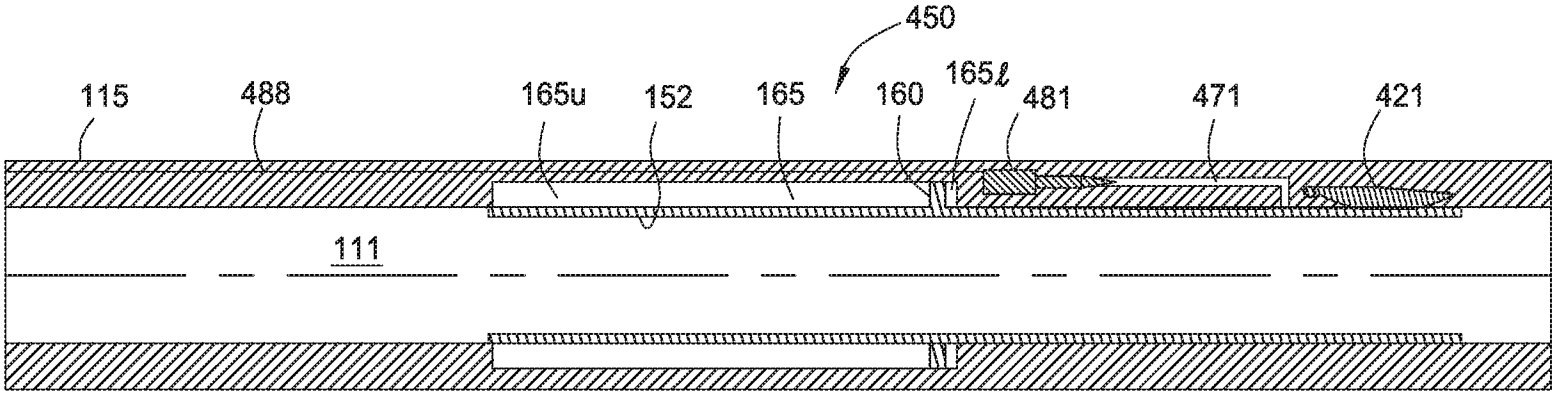
FIGS. 4A and 4B illustrate another embodiment of an isolation valve in the open position and closed position, respectively.
Figure 4B:
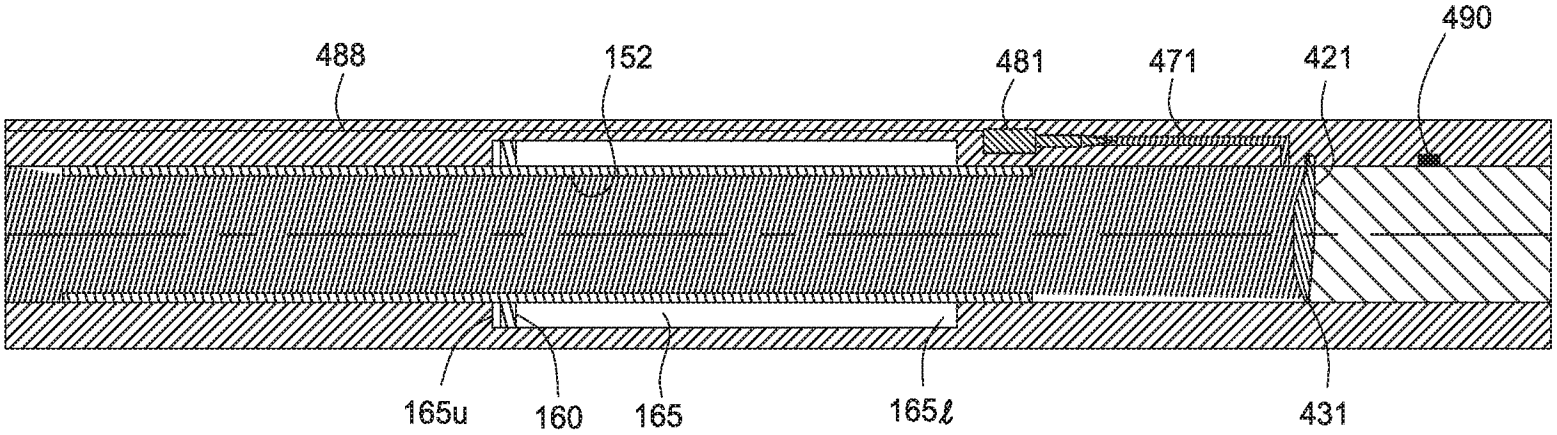

FIGS. 4A-4B illustrate another exemplary embodiment of an isolation valve 450. FIG. 4A shows the isolation valve 450 in an open position, and FIG. 4B shows the isolation valve 450 in the closed position. The isolation valve 450 includes a tubular housing 115, an opener such as a flow tube 152, and an isolation member 421. The isolation valve 450 may have a longitudinal bore 111 extending therethrough for passage of fluid and the drill string.

In one embodiment, the isolation member 421 is a flapper. The flapper 421 engages a respective seat 431 when the flapper is in the closed position. The flapper 421 may be pivotally coupled to the seat 431 using a hinge 439. The flapper 421 pivots about the hinge 439 between an open position, as shown in FIG. 4A, and a closed position, as shown in FIG. 4B. The flapper 421 may be positioned below the seat 431 such that the flapper 421 opens downwardly. An inner periphery of the flapper 421 engages the seat 431 in the closed position, thereby closing fluid communication through the isolation valve 450. The interface between the flapper 421 and the seat 431 may be a metal to metal seal. The flapper 421 may be biased toward the closed position such as by a spring.

The flow tube 152 is disposed within the housing 115 and longitudinally movable relative thereto between an upper position (shown in FIG. 4B) and a lower position (shown in FIG. 4A). The flow tube 152 is configured to urge the flapper 421 toward the open position when the flow tube 152 moves to the lower position. The flow tube 152 may have one or more portions connected together. A piston 160 is coupled to the flow tube 152 for moving the flow tube 152 between the lower position and the upper position. The piston 160 carries a seal for sealing an interface formed between an outer surface of the piston 160 and an inner surface of the housing 115.

A piston chamber 165 is disposed between an inner surface of the housing 115 and an outer surface of the flow tube 152. The piston chamber 165 may be defined radially between the flow tube 152 and a recess in the housing 115 and longitudinally between an upper shoulder and a lower shoulder in the recess. The piston 160 separates the chamber 165 into an upper chamber 165*u* and a lower chamber 165*l*. Each of the lower chamber 165*l* and the upper chamber 165*u* fluidly communicates with a respective control line. Fluid is supplied to the upper chamber 165*u* to move the piston 160 and the flow tube 152 downward to the lower position. To return the flow tube 152 to the upper position, fluid is supplied to the lower chamber 165*l* to move the piston 160 and the flow tube 152 upward.

The flapper 421 is opened and closed by interaction with the flow tube 152. FIG. 4A shows the flapper 421 in the open position. Downward movement of the flow tube 152 causes the lower portion of the flow tube 152 to engage with the flapper 421, thereby pushing and pivoting the flapper 421 to the open position against the springs. The flow tube 152 is urged downward when the pressure in the upper chamber 165*u* is greater than the pressure in the lower chamber 165*l*. The pressure differential between the upper chamber 165*u* and the lower chamber 165*l* may be controlled by increasing the pressure in the upper chamber 165*u*, decreasing the pressure in the lower chamber 165*l*, or combinations thereof. Pressure in the upper chamber 165*u* and the lower chamber 165*l* may be controlled via their respective control lines.

As shown in FIG. 4A, the flow tube 152 has extended past and pivoted the flapper 421 to the open position. The flow tube 152 may sealingly engage an inner surface of the housing 115 below the flapper 421. Also, the piston 160 has moved downward relative to the housing 115, thereby decreasing the size of the lower chamber 165*l*.

To close the flapper 421, the flow tube 152 is moved upward to disengage from the flapper 421, thereby allowing the flapper 421 to pivot to the closed position. In one embodiment, the flapper 421 is pivoted to the closed position by the spring. The flow tube 152 is urged upward when the pressure in the lower chamber 165*l* is greater than the pressure in the upper chamber 165*u*. The pressure differential between the upper chamber 165*u* and the lower chamber 165*l* may be controlled by decreasing the pressure in the upper chamber 165*u*, increasing the pressure in the lower chamber 165*l*, or combinations thereof. Pressure in the upper chamber 165*u* and the lower chamber 165*l* may be controlled via their respective control lines. As shown in FIG. 4B, the flow tube 152 has retracted to a position above the flapper 421. Also, the piston 160 has moved upward to reduce the size of the upper chamber 165*u*.

In one embodiment, the isolation valve 450 includes a leak detection device. In one example, the leak detection device 470 includes a channel 471 in fluid communicate with a section of the bore 111 located above the isolation member 421. A pressure gauge 481 is located in the distal end of the channel 471. In one embodiment, pressure gauge 481 is configured to measure the pressure of the fluid in the channel 471 communicated from the bore 111.

In one or more examples described herein, the leak detection device, such as leak detection devices 370 and 470, is in fluid communication with the section of the bore 111 located between 0.1 in. and 30 ft. above the isolation member 421. In another example, the leak detection device, such as leak detection devices 370 and 470, is in fluid communication with the section of the bore 111 located between 0.1 in. and 10 ft. or between 0.1 in. and 5 ft. above the isolation member 421.

When the isolation member 421 is closed, the pressure in the section of the bore 111 above the isolation member 421 can be monitored to detect leaks across the isolation member 421. In this respect, any change in pressure, for example hydrostatic pressure, may indicate a leak has occurred.

In another embodiment, a second isolation member may be positioned above the inlet of the channel 471. In this respect, the pressure gauge may measure the pressure between the two isolation members. Any changes in the pressure between the two isolation members may indicate a leak has occurred.

In another embodiment, a pressure reading is taken at a location below the isolation member 421. In one example, a pressure gauge 490 is provided at a location below the isolation member 421. The data from the pressure gauge 490 can be used as a reference for comparison to the data acquired by the pressure gauge 481 located above the isolation member 421. The reference pressure gauge 490 may be used with other suitable embodiments described herein. In another example, the pressure gauge is located at a different location, such as a higher location. The pressure from below the isolation member 421 can be communicated to the pressure gauge via a channel.

In one embodiment, communication from the pressure gauge 481 and the optional pressure gauge 490 can be made using wireline, electric cable, fiber optics, or transmitter. In one example, the pressure measurements are sent to a controller at the surface using a wire 488. In another example, the pressure measurements are sent to a downhole controller, which sends the measurements to the surface. In yet another embodiment, the measurement device can send a signal via a control line to a multiplexer, which can send a signal through a control line or a transmitter. Suitable wireless signals include electromagnetic signal, radio frequency signal, acoustic signal, and combinations thereof.

Figure 5A:
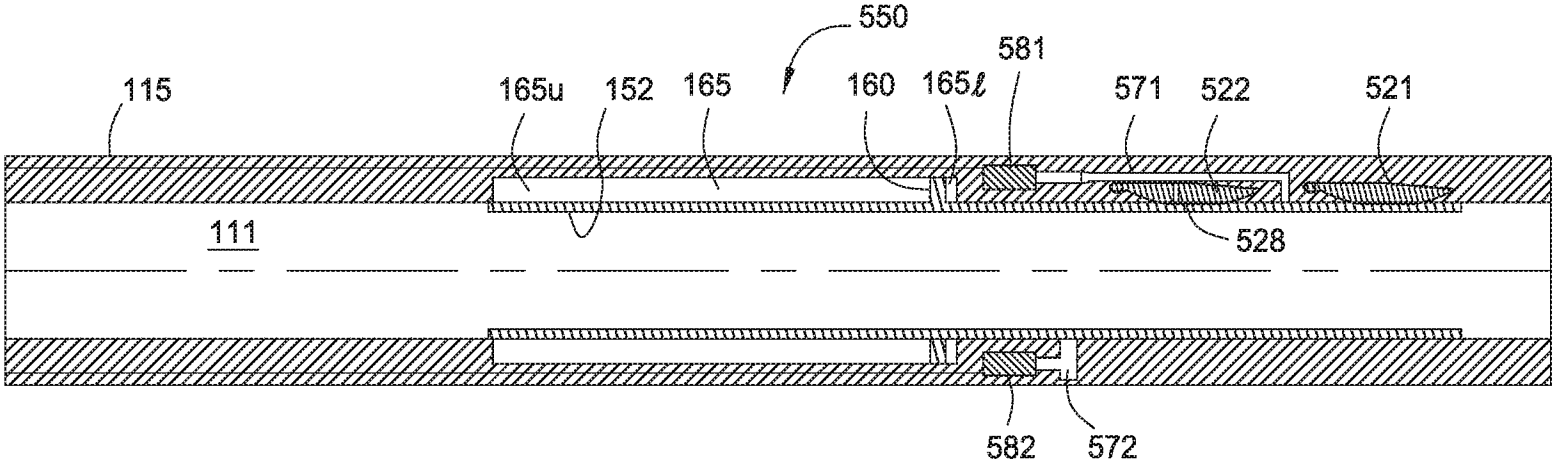
FIGS. 5A and 5B illustrate another embodiment of an isolation valve in the open position and closed position, respectively.
Figure 5B:
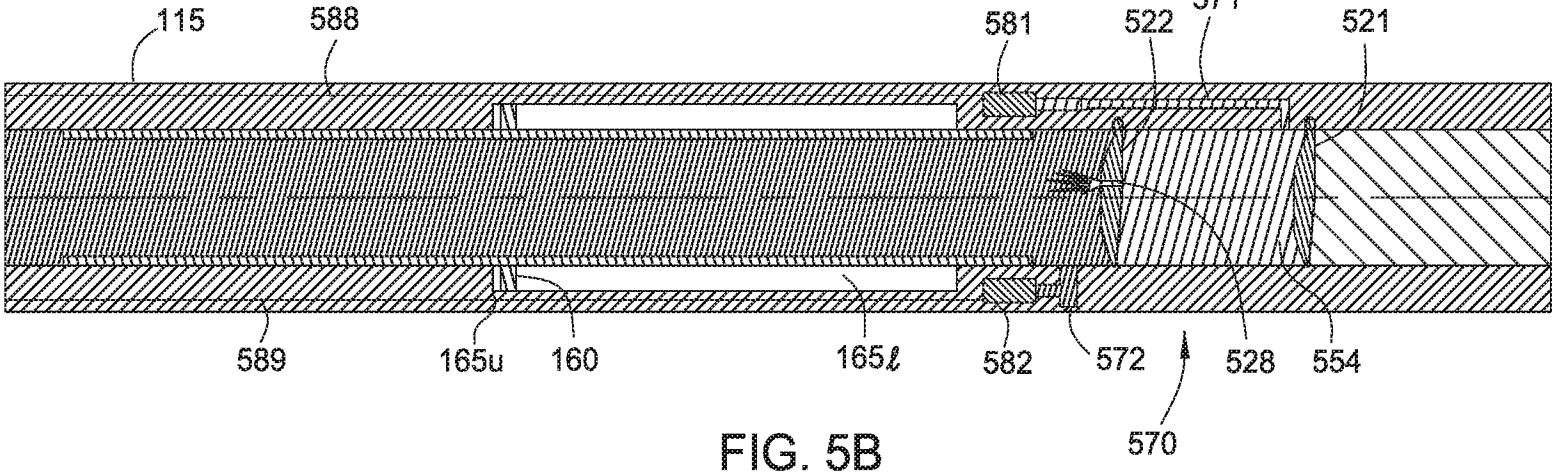

FIGS. 5A-5B illustrate another exemplary embodiment of an isolation valve 550. FIG. 5A shows the isolation valve 550 in an open position, and FIG. 5B shows the isolation valve 550 in the closed position. The isolation valve 550 includes a tubular housing 115, an opener such as a flow tube 152, a first isolation member 521, and a second isolation member 522. The isolation valve 550 may have a longitudinal bore 111 extending therethrough for passage of fluid and the drill string.

In one embodiment, the first and second isolation members 521, 522 are flappers. The flappers 521, 522 engage a respective seat 531, 532 when the flappers are in the closed position. The flappers 521, 522 may be pivotally coupled to the seats 531, 532 using a hinge. The flappers 521, 522 pivot about the hinge between an open position, as shown in FIG. 5A, and a closed position, as shown in FIG. 5B. The flappers 521, 522 may be biased toward the closed position such as by a spring.

The flow tube 152 is disposed within the housing 115 and longitudinally movable relative thereto between an upper position (shown in FIG. 5B) and a lower position (shown in FIG. 5A). The flow tube 152 is configured to urge the flappers 521, 522 toward the open position when the flow tube 152 moves to the lower position. A piston 160 is coupled to the flow tube 152 for moving the flow tube 152 between the lower position and the upper position. The piston 160 carries a seal for sealing an interface formed between an outer surface of the piston 160 and an inner surface of the housing 115.

A piston chamber 165 is disposed between an inner surface of the housing 115 and an outer surface of the flow tube 152. The piston chamber 165 may be defined radially between the flow tube 152 and a recess in the housing 115 and longitudinally between an upper shoulder and a lower shoulder in the recess. The piston 160 separates the chamber 165 into an upper chamber 165*u* and a lower chamber 165*l*. Each of the lower chamber 165*l* and the upper chamber 165*u* fluidly communicates with a respective control line. Fluid is supplied to the upper chamber 165*u* to move the piston 160 and the flow tube 152 downward to the lower position. To return the flow tube 152 to the upper position, fluid is supplied to the lower chamber 165*l* to move the piston 160 and the flow tube 152 upward.

The flappers 521, 522 are opened and closed by interaction with the flow tube 152. FIG. 5A shows the flappers 521, 522 in the open position. As shown, the flow tube 152 has extended past and pivoted the flappers 521, 522 to the open position. The flow tube 152 may sealingly engage an inner surface of the housing 115 below the first flapper 521.

To close the flappers 521, 522, the flow tube 152 is moved upward to disengage from the flappers 521, 522, thereby allowing the flappers 521, 522 to pivot to the closed position. In one embodiment, the flappers 521, 522 are pivoted to the closed position by their respective spring. The flow tube 152 is urged upward when the pressure in the lower chamber 165*l* is greater than the pressure in the upper chamber 165*u*. The pressure differential between the upper chamber 165*u* and the lower chamber 165*l* may be controlled by decreasing the pressure in the upper chamber 165*u*, increasing the pressure in the lower chamber 165*l*, or combinations thereof. Pressure in the upper chamber 165*u* and the lower chamber 165*l* may be controlled via their respective control lines. As shown in FIG. 5B, the flow tube 152 has retracted to a position above the second flapper 522. Also, the piston 160 has moved upward to reduce the size of the upper chamber 165*u*.

In one embodiment, the isolation valve 550 includes a leak detection device. In one example, the leak detection device 570 includes a first channel 571 in fluid communication with an enclosed section 554 of the bore 111 between the two flappers 521, 522. A first pressure gauge 581 is located in the channel 571. The first pressure gauge 581 is configured to measure the pressure of the fluid in the enclosed section 554. A second channel 572 is in fluid communication with a section of the bore 111 located above the second flapper 522. A second pressure gauge 582 is located in the channel 572 and configured to measure the pressure of the fluid in the channel 572 communicated from the bore 111. The second flapper 522 includes an orifice 528 having a predetermined size formed through the second flapper 522 to allow fluid communication between the enclosed section 554 and the section above the second flapper 522. Each of the pressure gauges 581, 582 is configured to communicate the measured pressure to a controller, which may be located at the surface. In this arrangement, the second flapper 522 acts similarly to an orifice plate for determining the flow rate in the enclosed section 554. The flow rate can be determined by measuring difference in pressure above and below the second flapper and applying Bernoulli's principle. A positive flow rate may indicate a leak has occurred across the first flapper 521. The flow rate may be determined at the surface by sending the measured pressures to the surface, or determined downhole by sending the measured pressured to the downhole controller.

In one embodiment, communication from the pressure gauges 581, 582 can be made using wireline, electric cable, fiber optics, or transmitter. In one example, the pressure measurements are sent to a controller at the surface using wires 588, 589. In another example, the pressure measurements are sent to a downhole controller, which sends the measurements to the surface. In yet another embodiment, the measure valve can send a signal via a control line to a multiplexer, which can send a signal through a control line or a transmitter. Suitable wireless signals include electromagnetic signal, radio frequency signal, acoustic signal, and combinations thereof.

Figure 6:
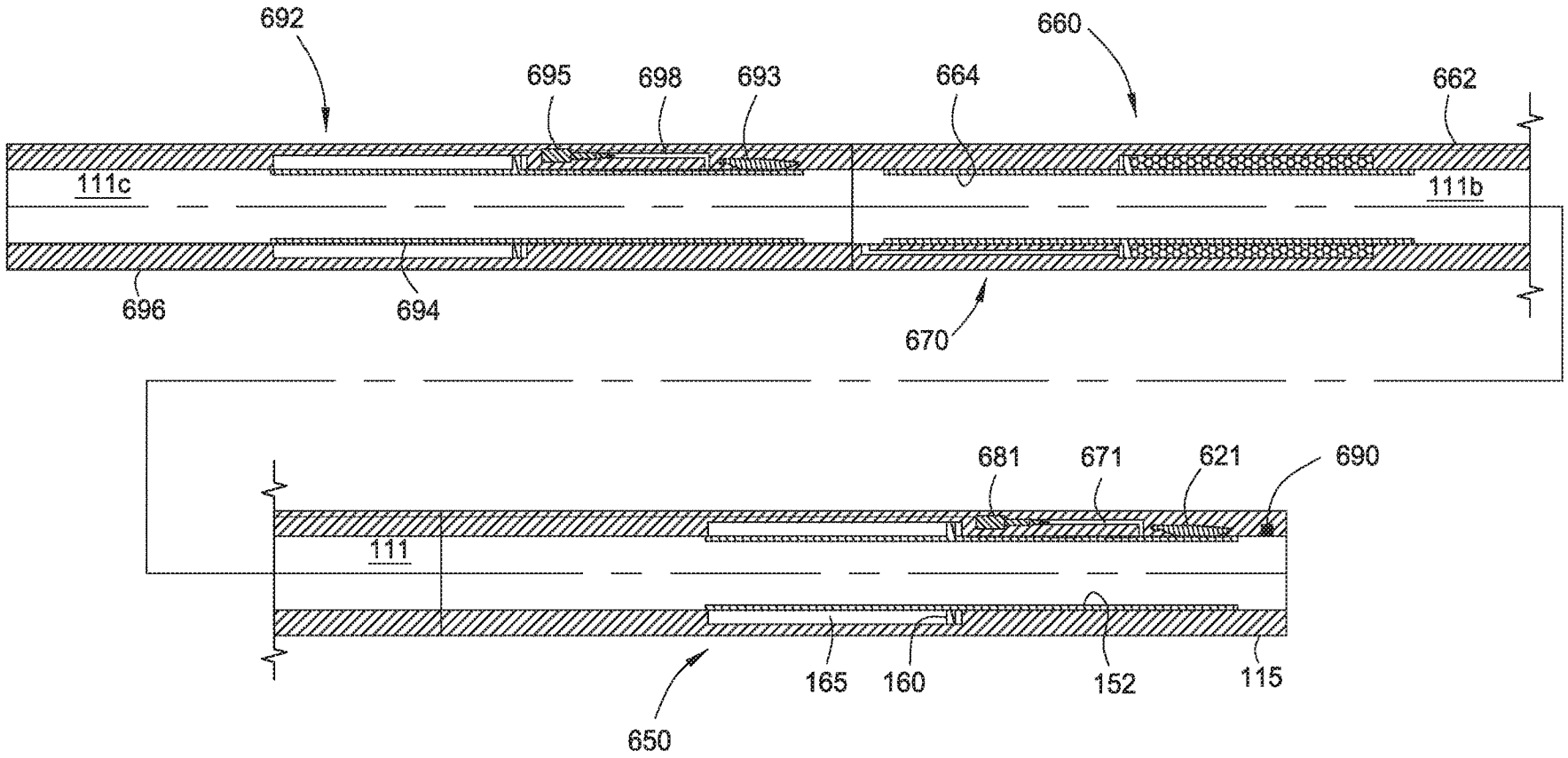
FIG. 6 illustrates another embodiment of an isolation valve in an open position.
Figure 7:
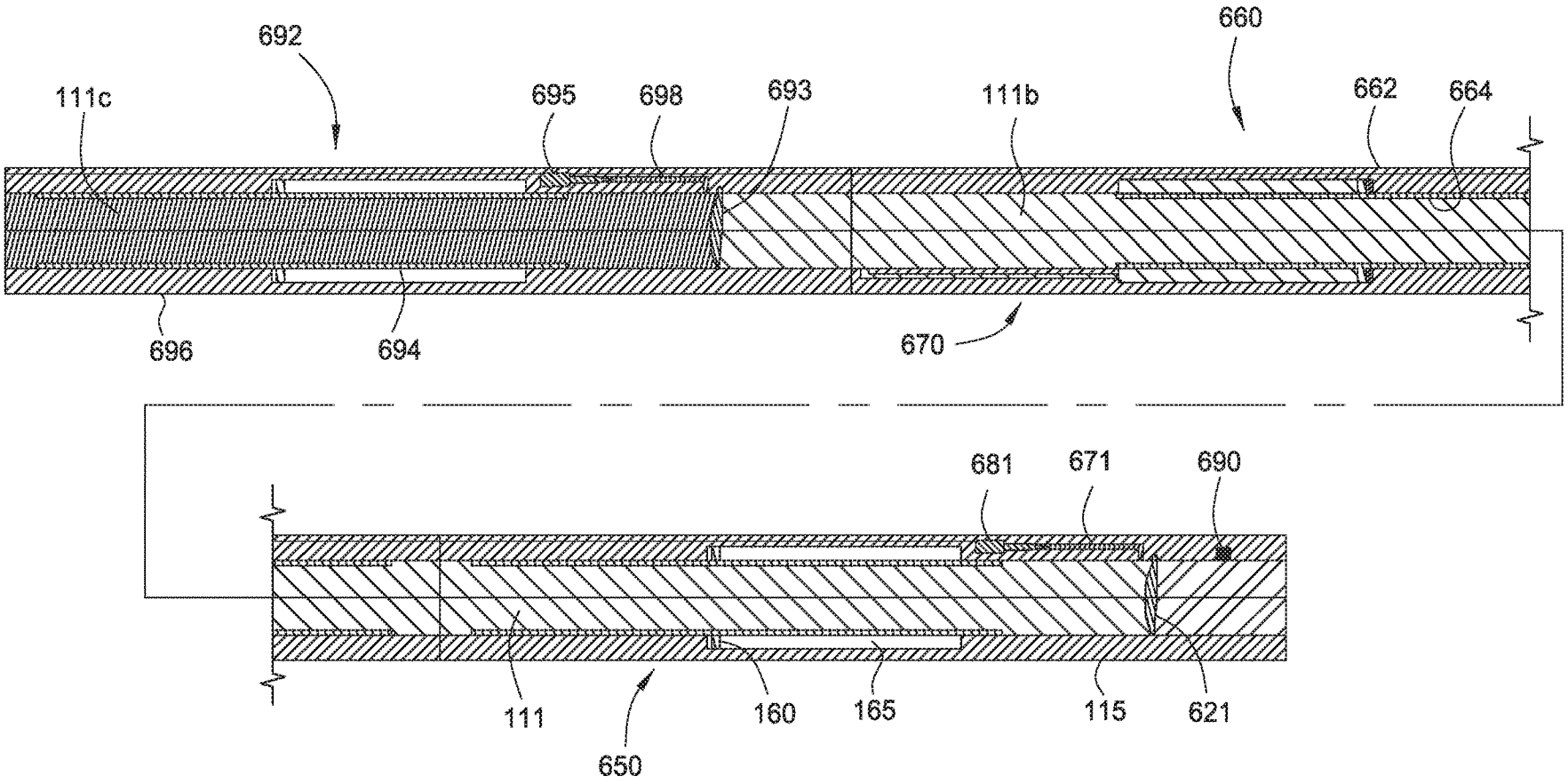
FIG. 7 illustrates the isolation valve of FIG. 6 in a closed position.

FIGS. 6-7 illustrate another exemplary embodiment of an isolation valve 650 having a leak detection device 670. FIG. 6 shows the isolation valve 650 in an open position, and FIG. 7 shows the isolation valve 650 in the closed position. The isolation valve 650 includes a tubular housing 115, an opener such as a flow tube 152, and an isolation member 621. The isolation valve 650 may have a longitudinal bore 111 extending therethrough for passage of fluid and the drill string.

In this embodiment, the isolation valve 650 is substantially similar to the isolation valve 450 shown in FIG. 4A. For sake of clarity, components of the isolation valve 650 similar in function and structure of the isolation valve 450 of FIG. 4A will not be described in detail. As shown, the isolation member 621 is a flapper. The flapper 621 engages a respective seat when the flapper 621 is in the closed position. The flapper 621 pivots about the hinge between an open position, as shown in FIG. 6, and a closed position, as shown in FIG. 7.

The flow tube 152 is disposed within the housing 115 and longitudinally movable relative thereto between an upper position (shown in FIG. 7) and a lower position (shown in FIG. 6). The flow tube 152 is configured to urge the flapper 621 toward the open position when the flow tube 152 moves to the lower position. A piston 160 is coupled to the flow tube 152 for moving the flow tube 152 between the lower position and the upper position. The piston 160 separates a piston chamber 165 into an upper chamber and a lower chamber. Fluid is supplied to the upper chamber to move the piston 160 and the flow tube 152 downward to the lower position. To return the flow tube 152 to the upper position, fluid is supplied to the lower chamber to move the piston 160 and the flow tube 152 upward.

The flapper 621 is opened and closed by interaction with the flow tube 152. FIG. 6 shows the flapper 621 in the open position. Downward movement of the flow tube 152 causes the lower portion of the flow tube 152 to engage with the flapper 621, thereby pushing and pivoting the flapper 621 to the open position against the springs. To close the flapper 621, the flow tube 152 is moved upward to disengage from the flapper 621, thereby allowing the flapper 621 to pivot to the closed position. In one embodiment, the flapper 621 is pivoted to the closed position by the spring. The flow tube 152 is urged upward when the pressure in the lower chamber is greater than the pressure in the upper chamber.

In one embodiment, the isolation valve 650 includes a leak detection device. In this example, the leak detection device 670 includes a pressure gauge 681 in fluid communicate with a section of the bore 111 located above the isolation member 621. The leak detection device 670 optionally includes a closure device 692 and a charging device 660 disposed between the closure device 692 and the isolation valve 650. An optional channel 671 is used to communicate pressure in the bore 111 to the pressure gauge 681. An optional pressure gauge may be located below the flapper 621 to measure the pressure in the bore 111 after the flapper 621 is closed. In one example, the combined length of the isolation valve 650, the charging device 660, and the closure device 692 is between about 2 ft. and 80 ft., such as between 3 ft. and 40 ft.

In one embodiment, the closure device 692 is an isolation valve such as a flapper valve. The closure device 692 includes a housing 696 having a bore 111*c* therethrough. A flapper 693 is used to open or close fluid communication through the bore 111*c*, and the flapper 693 is operable using a piston operated flow tube 694. Other suitable closure devices include a ball valve, gate valve, segmented flapper valve, plug valve, and packer. The closure device 692 optionally includes a pressure gauge 695 disposed above the flapper 693 for measuring the pressure above flapper 693. The pressure from the bore 111*c* may be communicated to the pressure gauge 695 using an optional channel 698. In one example, the distance between the flapper 621 of the isolation valve 650 and the flapper 693 of the closure device 692 is between about 2 ft. and 60 ft., such as between 2 ft. and 30 ft and between 3 ft. and 8 ft.

Figure 6A:
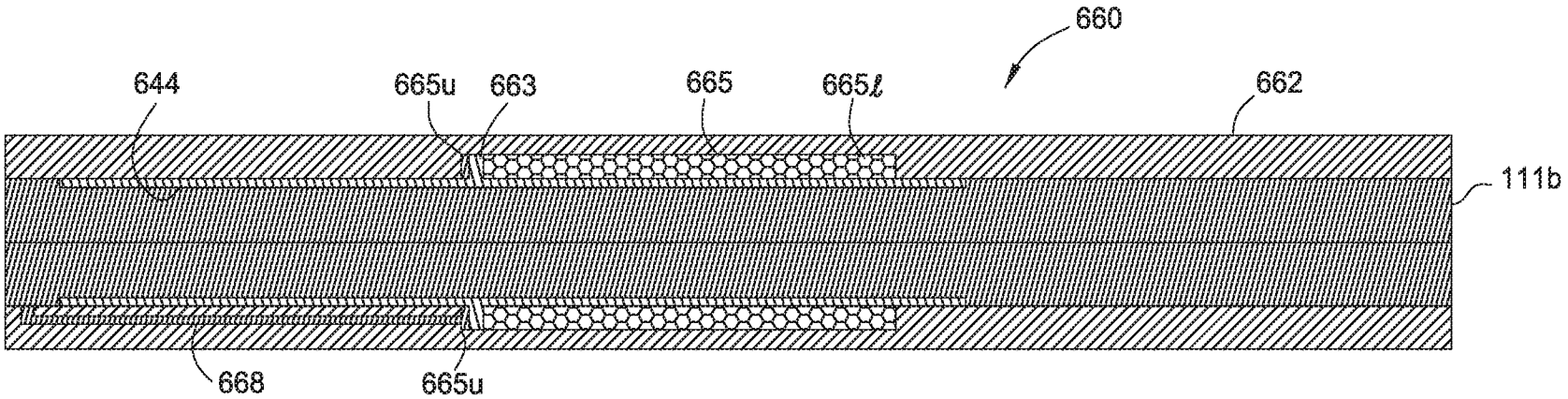
FIG. 6A illustrates an exemplary embodiment of a charging device in an expanded state.
Figure 6B:
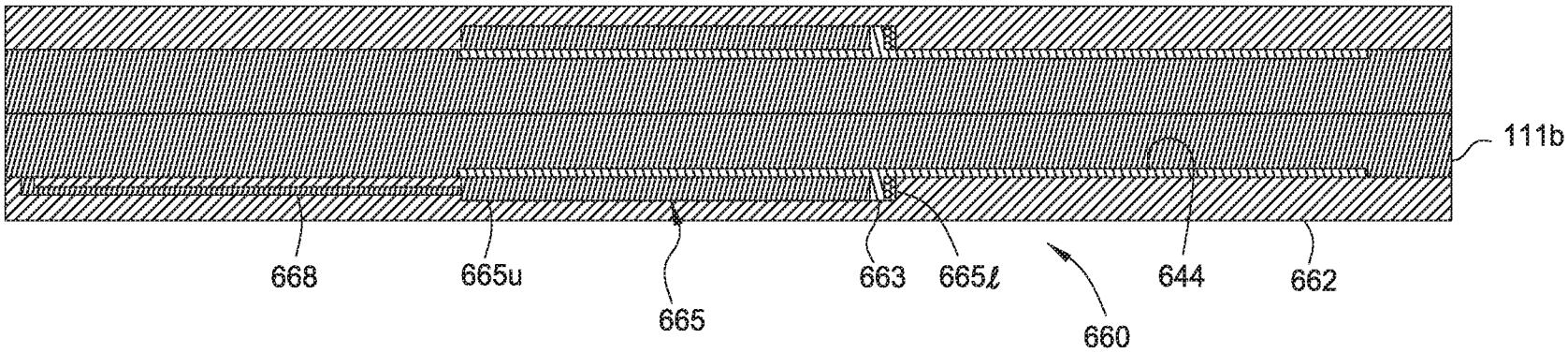
FIG. 6B illustrates the charging device of FIG. 6A in a compressed state.

FIGS. 6A and 6B shows an enlarged view of the charging device 660. The charging device 660 includes a housing 662 having a bore 111*b* therethrough. The housing 662 is connectable to or integral with the housing 115 of the isolation valve 650. The bore 111*b* is in fluid communication with the bore 111 of the isolation valve 650.

A flow tube 664 is disposed within the housing 662 and longitudinally movable relative thereto between an upper position (shown in FIG. 6A) and a lower position (shown in FIG. 6B). A piston 663 is coupled to the flow tube 664 for moving the flow tube 664 between the lower position and the upper position. The piston 663 carries a seal for sealing an interface formed between an outer surface of the piston 663 and an inner surface of the housing 662.

A piston chamber 665 is disposed between an inner surface of the housing 115 and an outer surface of the flow tube 664. The piston chamber 665 may be defined radially between the flow tube 664 and a recess in the housing 115 and longitudinally between an upper shoulder and a lower shoulder in the recess. The piston 160 separates the chamber 665 into an upper chamber 665*u* and a lower chamber 665*l*. The upper chamber 665*u* is in fluid communication with the bore 111*b* via a channel 668. The lower chamber 665*l* is supplied with a pressurized fluid at a predetermined pressure. Suitable pressurized fluids include a gas such as nitrogen. In one embodiment, the pressure in the lower chamber 665*l* is less than the hydrostatic pressure of the planned location of the isolation valve 650. For example, the pressure in the lower chamber 665*l* is between 80% and 99.5% of the hydrostatic pressure at the planned location of the isolation valve 650; preferably between 90% and 99.5%; and more preferably between 95% and 99.5%. In another example, the pressure in the lower chamber 665*l* is configured to provide a pressure differential with the hydrostatic pressure at the planned location of the isolation valve 650 in a range between 0.5 psi and 50 psi, such as a pressure differential between 1 psi and 20 psi. In one embodiment, the lower chamber 665*l* is connected to a control line for pressurizing the lower chamber 665*l*. In another embodiment, the lower chamber 665*l* includes a biasing member such as a spring and optionally includes a pressurizable fluid. In a further embodiment, the lower chamber 665*l* is charged using hydraulic fluid for operating the flapper 621. For example, after closing the flapper 621, hydraulic pressure continues to increase until a valve, such as a pop-off valve, opens to divert the hydraulic fluid to the lower chamber 665*l*.

In operation, the isolation valve 650 is equipped with a leak detection device for detecting a leak across the isolation valve 650. A charging device 660 is connected between the isolation valve 650 and the closure device 692. The charging device 660 is configured to provide a pressure differential across the flapper 621 of the isolation valve 650. In this example, the lower chamber 665*l* of the charging device 660 is pre-charged to a pressure differential between 80% and 99.5% of the hydrostatic pressure at the planned location of the isolation valve 650.

The isolation device 650 is run-in with its flapper 621 and the closure device 692 in the open position, as shown in FIG. 6. FIG. 6A shows the lower chamber 665*l* of the charging device 660 in an expanded position during run-in. After reaching the planned location, the formation pressure is communicated to the upper chamber 665*u* of the charging device 660 via the channel 668 communicating with the bore 111*b* and the upper chamber 665*u*. The formation pressure is sufficient to overcome the pressure in the lower chamber 661, thereby urging the piston 663 to compress the lower chamber 665*l*, as shown in FIG. 6B.

Pressure is supplied to the lower chamber 165 of the isolation device 650 to close the flapper 621. The increased pressure moves the flow tube 152 upward and away from the flapper 621, thereby allowing the flapper 621 to pivot to the closed position. After closing, pressure above the flapper 621 is reduced to create a pressure differential across the flapper 621. The reduced pressure is sufficient to keep the piston 663 at least partially compressed.

The closure device 692 is then closed to close off the bore 111*b* between the closure device 692 and the flapper 621 of the isolation device 650. In this example, the closure device 692 is closed by supplying pressure to move the flow tube 694 upward and away from the flapper 693, thereby allowing the flapper 693 to pivot to the closed position. After closing, pressure above the flapper 693 is reduced to create a pressure differential between across the flapper 693. FIG. 7 shows both flappers 621, 693 closed and the lower chamber 665*l* in the compressed state.

After both flappers 621, 693 are closed, the lower chamber 665*l* will expand if the pressure in the bore 111*b* is less than the pressure in the lower chamber 665*l*. The lower chamber 665*l* will expand until an equilibrium is reached or the lower chamber 665*l* has reached maximum expansion. A leak across the flapper 621 of will cause a pressure increase in the bore 111*b* that is communicated to the pressure gauge 681. The pressure gauge 681 is configured to communicate the measured pressure to a controller, which may be located at the surface.

In another embodiment, a pressure gauge 690 may be provided at a location below the isolation member 621. The data from the pressure gauge 690 can be used as a reference for comparison to the data acquired by the pressure gauge 681 located above the isolation member 621. The reference pressure gauge 690 may be used with other suitable embodiments described herein.

In one embodiment, communication from the pressure gauge 681 and the optional pressure gauge 690 can be made using wireline, electric cable, fiber optics, or transmitter. In one example, the pressure measurements are sent to a controller at the surface using a wire 488. In another example, the pressure measurements are sent to a downhole controller, which sends the measurements to the surface. In yet another embodiment, the measurement device can send a signal via a control line to a multiplexer, which can send a signal through a control line or a transmitter. Suitable wireless signals include electromagnetic signal, radio frequency signal, acoustic signal, and combinations thereof.

In one embodiment, communication from the valves to the surface is made using a control line that can carry hydraulic fluid and/or electrical currents, such as wireline, electric cable, hydraulic control line, and combinations thereof. For example, when the measurement valve opens, the fluid pressure from the channel is communicated to the control line, which in turn, communicates with the surface, such as a controller located at the surface. In another embodiment, the measurement valve can, after activating, send an electrical signal or an optical signal to a controller at the surface. In yet another embodiment, the measurement valve, after activating, can send a signal to a downhole controller. In turn, the downhole controller sends a wireless signal to another controller at the surface. In yet another embodiment, the measure valve can send a signal via a control line to a multiplexer, which can send a signal through a control line or a transmitter. Suitable wireless signals include electromagnetic signal, radio frequency signal, acoustic signal, and combinations thereof.

In any of the embodiments described herein, the control line may extend from the surface, through the wellhead, along an outer surface of the casing string, and to the isolation valve. The control line may be fastened to the casing string at regular intervals. Hydraulic fluid may be disposed in the upper and lower chambers. The hydraulic fluid may be an incompressible liquid, such as a water based mixture with glycol, a refined oil, a synthetic oil, or combinations thereof; a compressible fluid such an inert gas, e.g., nitrogen; or a mixture of compressible and incompressible fluids. In yet another embodiment, a plurality of isolation valves may be attached to the tubular string. Each of the isolation valves may be operated using the same or different hydraulic mechanisms described herein. For example, plurality of isolation valves may be attached in series and each of the valves may be exposed to the bore pressure on one side and attached to a different control line.

In one embodiment, an isolation valve for use with a tubular string includes a tubular housing for connection with the tubular string; a first closure member disposed in the housing and movable between an open position and a closed position; a second closure member disposed in the housing and movable between an open position and a closed position; a chamber formed between the first closure member and the second closure member when the first and second closure members are in the closed position; and a leak detection device configured to measure a fluid flow into the chamber.

In one or more of the embodiments described herein, the leak detection device includes a flow measuring device attached to the second closure member.

In one or more of the embodiments described herein, the second closure member is located upstream from the first closure member.

In one or more of the embodiments described herein, the flow measuring device is selected from the group consisting of an optical multiphase flow meter, microelectromechanical flow meter, and a venturi based flow meter.

In one or more of the embodiments described herein, the leak detection device includes one or more channels in fluid communication with the chamber; and one or more measurement valves for controlling fluid communication through the one or more channels.

In one or more of the embodiments described herein, the one or more channels provides selective fluid communication between the chamber and a section of the bore upstream from the second closure member.

In one or more of the embodiments described herein, each of the one or more measurement valves is configured to open in response to a predetermined pressure differential between the chamber and the section of the bore upstream from the second closure member.

In one or more of the embodiments described herein, a plurality of measurement valves is used and the plurality of measurement valves opens sequentially.

In one or more of the embodiments described herein, a number of measurement valves opening is less than a number of measurement valves provided in the isolation valve.

In one or more of the embodiments described herein, the number of measurement valves opening is proportional to a pressure differential between the chamber and the section of the bore upstream from the second closure member.

In one or more of the embodiments described herein, the leak detection device includes two channels, three channels, four channels, five channels, or six channels.

In one or more of the embodiments described herein, communication to surface uses at least one of control line, wireline, and electric cable.

In one or more of the embodiments described herein, the valve includes a flow tube longitudinally movable relative to the housing for opening the second closure member.

In one or more of the embodiments described herein, the leak detection device includes an orifice disposed in the second closure member and configured to allow fluid communication between the chamber and a bore section above the second closure member when the second closure member is in the closed position; a first pressure gauge for measuring a first pressure in the chamber; and a second pressure gauge for measuring a second pressure in the bore section above the second closure member.

In one or more of the embodiments described herein, the valve includes at least one of a control line, an optical line, an electric line, a wireless transmission, and combinations thereof for communicating the measured first pressure and the second pressure.

In another embodiment, a method of detecting a leak across an isolation valve includes closing a first isolation member to block fluid communication through a bore; closing a second isolation member located upstream from the first isolation chamber, thereby defining a chamber between the first and second isolation chambers; and measuring fluid flow into the chamber.

In one or more of the embodiments described herein, measuring fluid flow into the chamber comprises measuring fluid flowing through a flow measuring device attached to the second isolation member.

In one or more of the embodiments described herein, measuring fluid flow into the chamber includes flowing fluid in the chamber through a channel in selective fluid communication between the chamber and a section of a bore upstream from the second isolation member; and opening a measurement valve in the channel in response to a predetermine pressure differential between the chamber and the section of the bore upstream from the second isolation member.

In one or more of the embodiments described herein, fluid flows into a plurality of channels.

In one or more of the embodiments described herein, the plurality of channels open sequentially.

In one or more of the embodiments described herein, the second isolation member includes an orifice, and the method includes measuring a first pressure in the chamber; measuring a second pressure of the bore above the second isolation member; and determining a flow rate across the orifice using the measure first pressure and the second pressure.

In one or more of the embodiments described herein, the method includes sending the measured first pressure and second pressure to the surface using one of a control line, optical line, electric line, wireless transmission, and combinations thereof.

In one or more of the embodiments described herein, the method includes communicating a pressure in the chamber to a charging device having a charged chamber; and equalizing the pressure in the chamber with a pressure in the charged chamber.

In one or more of the embodiments described herein, the method includes reducing a pressure above the first isolation member before closing the second isolation member.

In one or more of the embodiments described herein, the method includes a pressure in the bore is higher than a pressure in the charged chamber prior to closing the first isolation chamber.

In another embodiment, a method of detecting a fluid leak across an isolation valve in a bore of a tubular includes closing the isolation valve to block fluid communication through the bore; measuring a downhole pressure of the bore above the isolation valve; and determining the fluid leak in response to the measured downhole pressure.

In one or more of the embodiments described herein, the method includes measuring a pressure below the isolation valve; and comparing the measured pressure with the measured downhole pressure.

In one or more of the embodiments described herein, the method includes activating a closure device to close the bore at a location above the isolation valve and measuring the downhole pressure comprises measuring a downhole pressure between the isolation valve and the closure device.

In one or more of the embodiments described herein, the method includes communicating a fluid in the bore between the isolation valve and the closure device to a charging device having a charged chamber; and equalizing a pressure in the charged chamber with the pressure in the bore between the isolation valve and the closure device.

In one or more of the embodiments described herein, the method includes measuring a pressure above the closure device; and comparing the measured pressure with measured downhole pressure.

In one or more of the embodiments described herein, the method includes using a pressure gauge to measure the downhole pressure of the bore above the isolation valve In one or more of the embodiments described herein, the pressure gauge communicates with the bore via a channel in fluid communication with the bore.

In one embodiment, an isolation valve for use with a tubular string includes a tubular housing for connection with the tubular string and having a bore; a closure member disposed in the housing and movable between an open position and a closed position; and a pressure gauge for measuring a pressure in the bore above the closure member when the closure member is in the closed position.

In one or more of the embodiments described herein, the valve includes a channel in fluid communication with the bore above the closure member, and the pressure gauge is disposed in the channel.

In one or more of the embodiments described herein, at least one of a control line, an optical line, an electric line, a wireless transmission, and combinations thereof for communicating the measured pressure to a controller.

In one or more of the embodiments described herein, the valve includes a second pressure gauge for measuring a pressure in the bore below the closure member.

In one or more of the embodiments described herein, the valve includes a closure device disposed above the closure member; and a charging device disposed between the closure device and the closure member.

In one or more of the embodiments described herein, the closure device includes a closure member.

In one or more of the embodiments described herein, the charging device includes a charged chamber for pressurizing a bore of the charging device.

While the foregoing is directed to embodiments of the present disclosure, other and further embodiments of the disclosure may be devised without departing from the basic scope thereof, and the scope of the present invention is determined by the claims that follow.

The invention claimed is:

1. An isolation valve for use with a tubular string, comprising:

a tubular housing for connection with the tubular string;

a first closure member disposed in the housing and movable between an open position and a closed position;

a second closure member disposed in the housing and movable between an open position and a closed position, wherein the second closure member comprises a flapper;

a chamber formed between the first closure member and the second closure member when the first and second closure members are in the closed position; and a leak detection device configured to measure a fluid flow into the chamber, wherein the leak detection device includes an orifice disposed in the flapper and configured to allow fluid communication between the chamber and a bore section above the second closure member when the second closure member is in the closed position.

2. The isolation valve of claim 1, further comprising a flow tube longitudinally movable relative to the housing for opening the second closure member.

3. The isolation valve of claim 2, where the flow tube is configured to open the first closure member.

4. The isolation valve of claim 1, wherein the leak detection device comprises:

a first pressure gauge for measuring a first pressure in the chamber; and a second pressure gauge for measuring a second pressure in the bore section above the second closure member.

5. The isolation valve of claim 4, further comprises at least one of a control line, an optical line, an electric line, a wireless transmission, and combinations thereof for communicating the measured first pressure and the second pressure.

6. The isolation valve of claim 5, wherein the first closure member comprises a flapper.

7. The isolation valve of claim 6, further comprising a flow tube longitudinally movable relative to the housing for opening the second closure member and the first closure member.

8. The isolation valve of claim 7, where the second closure member is located upstream from the first closure member.

9. The isolation valve of claim 1, wherein the first closure member comprises a flapper.

10. The isolation valve of claim 9, further comprising a flow tube longitudinally movable relative to the housing for opening the second closure member and the first closure member.

11. The isolation valve of claim 1, where the second closure member is located upstream from the first closure member.

12. A method of detecting a leak across an isolation valve, comprising:

closing a first isolation member to block fluid communication through a bore;

closing a second isolation member located upstream from the first isolation chamber, thereby defining a chamber between the first and second isolation chambers, wherein the second isolation member comprises a flapper and the second isolation member having an orifice disposed in the flapper and configured to allow fluid communication between the chamber and a bore section above the second isolation member when the second isolation member is closed; and measuring fluid flow into the chamber by determining a flow rate across the orifice.

13. The method of claim 12, wherein determining the flow rate comprises:

measuring a first pressure in the chamber;

measuring a second pressure of the bore above the second isolation member; and determining the flow rate across the orifice using the measured first pressure and the measured second pressure.

14. The method of claim 13, further comprising sending the measured first pressure and second pressure to the surface using one of a control line, optical line, electric line, wireless transmission, and combinations thereof.

15. The method of claim 13, wherein closing the second isolation member comprises moving a flow tube longitudinally relative to the second isolation member.

16. The method of claim 12, wherein closing the second isolation member comprises moving a flow tube longitudinally relative to the second isolation member.

17. A method of detecting a fluid leak across an isolation valve in a bore of a tubular, comprising:

closing a first flapper of the isolation valve to block fluid communication through the bore;

activating a second flapper of a closure device by moving a flow tube longitudinally relative to the second flapper to close the bore at a location above the isolation valve, the second flapper having an orifice for communication through the bore;

measuring a downhole pressure between the closure device and the isolation valve;

measuring a pressure above the closure device;

comparing the measured pressure with the measured dowhole pressure; and determining the fluid leak in response to results from comparing the measured pressure with the measured downhole pressure.

18. The method of claim 17, wherein a pressure gauge is used to measure the downhole pressure of the bore above the isolation valve.

19. The method of claim 18, wherein the pressure gauge communicates with the bore via a channel in fluid communication with the bore.

20. An isolation valve for use with a tubular string, comprising:

a tubular housing for connection with the tubular string and having a bore;

a flapper disposed in the housing and movable between an open position and a closed position, the flapper having an orifice for fluid communication through the bore;

a pressure gauge for measuring a pressure in the bore above the flapper when the flapper is in the closed position; and a channel formed in a wall of the tubular housing and in fluid communication with the bore above the flapper, wherein the pressure gauge is disposed in the channel.

21. The isolation valve of claim 20, further comprising at least one of a control line, an optical line, an electric line, a wireless transmission, and combinations thereof for communicating the measured pressure to a controller.

22. The isolation valve of claim 20, further comprising a closure member disposed below the flapper, wherein the closure member is movable between an open position and a closed position.

23. A method of detecting a leak across an isolation valve, comprising:

closing a first isolation member to block fluid communication through a bore;

closing a second isolation member located upstream from the first isolation chamber, thereby defining a chamber between the first and second isolation chambers, the second isolation member having an orifice disposed in the second isolation member and configured to allow fluid communication between the chamber and a bore section above the second isolation member when the second isolation member is closed; and measuring fluid flow into the chamber by determining a flow rate across the orifice, wherein determining the flow rate comprises:

measuring a first pressure in the chamber;

measuring a second pressure of the bore above the second isolation member;

sending the measured first pressure and second pressure to a downhole controller; and determining the flow rate across the orifice using the measured first pressure and the measured second pressure.

* * * * *